US008985366B2

(12) United States Patent
Barth

(10) Patent No.: US 8,985,366 B2
(45) Date of Patent: Mar. 24, 2015

(54) INTERLOCKING DISPOSABLE TATTOO INK CONTAINER FOR TATTOOING, COSMETIC TATTOOING AND MICRO-PIGMENTATION APPLICATIONS

(71) Applicant: Intenze Products, Inc., Rochelle Park, NJ (US)

(72) Inventor: Mario Barth, Washington Township, NJ (US)

(73) Assignee: Intenze Products, Inc., Rochelle Park, NJ (US)

( * ) Notice: Subject to any disclaimer, the term of this patent is extended or adjusted under 35 U.S.C. 154(b) by 0 days.

(21) Appl. No.: 13/839,319

(22) Filed: Mar. 15, 2013

(65) Prior Publication Data

US 2014/0262841 A1 Sep. 18, 2014

(51) Int. Cl.
*B65D 21/02* (2006.01)

(52) U.S. Cl.
CPC ..... *B65D 21/0204* (2013.01)
USPC ..... 220/23.4; 220/23.2; 206/504

(58) Field of Classification Search
CPC . B65D 21/0204; B65D 21/0201; B65D 21/02
USPC ..... 206/504, 1.7, 558, 63.5, 368, 1.8; 220/23.2, 23.4, 23.83; 215/374, 375, 215/373
See application file for complete search history.

(56) References Cited

U.S. PATENT DOCUMENTS 3,366,265 A * 1/1968 Hesselbarth ..... 220/23.4
3,542,261 A * 11/1970 Greenberg ..... 222/576
3,815,281 A * 6/1974 Kander ..... 446/77
4,133,445 A * 1/1979 Mandelbaum ..... 220/23.4
4,253,830 A * 3/1981 Kazen et al. ..... 433/77
4,690,271 A * 9/1987 Zak ..... 206/1.7
4,770,297 A * 9/1988 Chang ..... 206/379
4,940,137 A * 7/1990 Straub ..... 206/139
4,966,298 A * 10/1990 Von Holdt ..... 220/23.4
4,982,858 A * 1/1991 von Holdt ..... 220/23.4
5,024,067 A * 6/1991 Maier, II ..... 62/457.4
5,050,755 A * 9/1991 Strawder ..... 220/23.4
5,381,916 A * 1/1995 Strawder ..... 220/23.4
5,638,974 A * 6/1997 Mann ..... 220/23.4
5,765,707 A * 6/1998 Kenevan ..... 220/4.28
5,810,192 A * 9/1998 Cruz ..... 220/475
6,719,161 B1 * 4/2004 Craig ..... 220/23.4
7,870,951 B1 * 1/2011 Orsi ..... 206/1.8
8,348,077 B2 * 1/2013 Wimmer ..... 220/23.4
8,459,452 B1 * 6/2013 Barth ..... 206/224
8,695,820 B2 * 4/2014 Rabie ..... 215/252
2003/0141300 A1 * 7/2003 French ..... 220/23.4
2006/0261063 A1 * 11/2006 Dyehouse ..... 220/23.4
2008/0202966 A1 * 8/2008 Fields et al. ..... 206/423
2009/0084690 A1 * 4/2009 Bressler et al. ..... 206/63.5
2012/0285952 A1 * 11/2012 James et al. ..... 220/23.4

* cited by examiner

*Primary Examiner* — Steven A. Reynolds
(74) *Attorney, Agent, or Firm* — Epstein Drangel LLP; Robert L. Epstein

(57) ABSTRACT

An interlocking container for tattoo ink includes a body defining a reservoir for retaining ink and first and second spaced interlocking members, each having a particular size and shape. The members extend outwardly from the container and define a space therebetween adapted to receive a similarly shaped and sized interlocking member from another container. An assembly of containers arranged in many different configurations can be formed by interlocking multiple containers together.

14 Claims, 3 Drawing Sheets

INTERLOCKING DISPOSABLE TATTOO INK CONTAINER FOR TATTOOING, COSMETIC TATTOOING AND MICRO-PIGMENTATION APPLICATIONS

BACKGROUND OF THE INVENTION

1. Field of the Invention

The present invention relates to single use, disposable containers for tattoo ink and more particularly, to single use, disposable containers for tattoo ink having interlock structure which stabilizes the containers to reduce accidental tipping and permits the tattoo artist to organize the containers on their work surface in whatever manner that suits their creative process.

2. Description of Prior Art Including Information Disclosed Under 37 CFR 1.97 and 1.98

It is well known that the use of ink from the same container for multiple tattoo clients can result in the transfer of disease, even if the instruments used are properly sterilized. However, small amounts of ink of various colors may be required for a particular client and discarding containers partially filled with ink after each client is wasteful and expensive. As a result, I have developed a unique and inexpensive disposable ink container intended for single use only has been developed to eliminate the possibility of cross-contamination and at the same time reduce the costs involved in having fresh ink available for each client. That container is the subject of U.S. patent application Ser. No. 13/588,354, filed Aug. 17, 2012, entitled "Disposable Tattoo Ink Container" which is incorporated herein by reference.

Those single use containers have been designed to be travel safe and durable. They include an adhesive layer on the bottom of the container which allows the containers to adhere to a surface in the tattoo booth such that the containers cannot be accidently knocked over or moved out of position as the tattoo artist is working, while at the same time allowing the tattoo artist to have both hands free to create the tattoo. The containers have a plastic cap which fits snuggly on the container body to prevent the tattoo ink from being spilled or contaminated by the environment during transport and handling. The containers are also provided with structure which facilitates removal of the cap.

However, those containers cannot be easily moved around once the adhesive layer has adhered to the work surface. They do not have the ability to connect with other similar containers to form an assembly in which the containers can be organized in many different configurations on the artist's work surface. Those containers cannot be connected together to achieve additional stability to prevent being accidentally tipped over. Further, they cannot be moved as a unit relative to the work surface as if situated on a tray.

Accordingly, I have invented an improved form of the single use, disposable tattoo contained which has the ability to connect with other similar containers to form an assembly in which the containers can be organized on the work surface in different configurations, in which the containers and be taken apart and reassembled in different configurations, which provides a high degree of stability without the use of adhesive, and which be moved as a unit relative to the work surface as if the containers were situated on a tray.

BRIEF SUMMARY OF THE INVENTION

In accordance with one aspect of the present invention, an interlocking container for tattoo ink is provided. The container includes a body defining a reservoir for retaining ink and means for engaging another container.

The engaging means includes first and second spaced interlocking members, each having a particular size and shape. The members define a space therebetween adapted to receive a similar member from another container. The space has substantially the particular size and shape of the members.

The engaging means includes at least one hollow member.

The container body has a rim. The engaging means extends from the rim.

The container body has a bottom surface situated in a plane. The engaging means extends to the plane.

The container body has an exterior surface. The engaging means is spaced from the exterior body surface.

The container body has a bottom and a substantially cylindrical wall with a rim. The engaging means includes a substantially skirt-like structure extending from the rim to the plane of the body bottom. The first and second spaced interlocking members extend from the skirt-like structure.

In accordance with another aspect of the present invention, first and second interlocking containers for tattoo ink are provided, each of the containers having a body defining a reservoir for retaining ink, and means for engaging the other container.

Each engaging means includes first and second spaced interlocking members, each having a particular size and shape. The members define a space therebetween adapted to receive a member from the other container. The members of each container define a space therebetween having substantially the particular size and shape.

Each engaging means includes at least one hollow member.

Each container body has a rim. Each of the engaging means extends from the rim.

Each container body has a bottom surface situated in a plane. Each engaging means extends to the plane.

Each container body has an exterior surface. Each engaging means is spaced from the exterior body surface.

Each container body has a bottom and a substantially cylindrical wall with a rim. Each engaging means includes a substantially skirt-like structure extending from the rim to the plane of the body bottom. Each engaging means includes first and second spaced interlocking members extending from the skirt-like structure.

BRIEF DESCRIPTION OF THE SEVERAL VIEWS OF DRAWINGS

To these and to such other objects that may hereinafter appears, the present invention relates to an interlocking disposable tattoo ink container as described in detail in the following specification and recited in the annexed claims, taken together with the accompanying drawings, in which like numerals refer to like parts and in which:

DETAILED DESCRIPTION OF THE INVENTION

Figure 1:
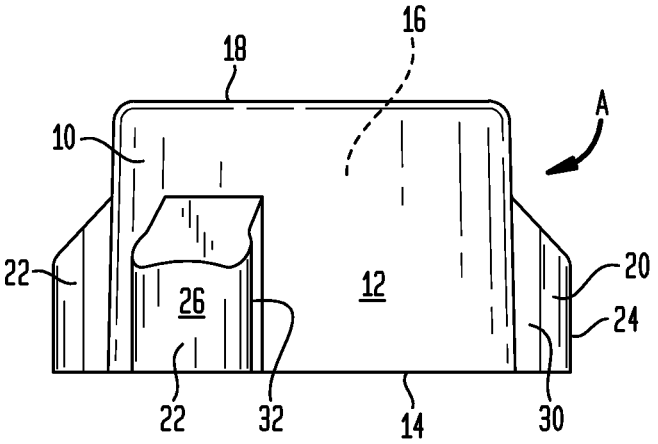
FIG. 1 is a side elevation view of the container of the present invention.
Figure 2:
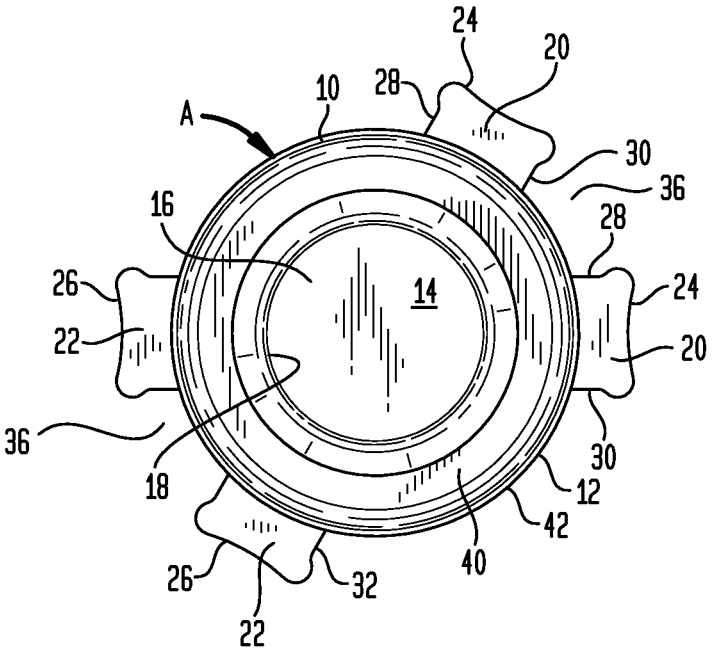
FIG. 2 is a top elevation view of the container.

As seen in the Figures, the present invention relates to an interlocking disposable container for tattoo ink, generally designated A, designed for a single use, that is, use in creating a tattoo on one client. Container A includes a generally cylindrical body 10 formed of a side wall with an exterior surface 12 and a closed bottom 14 defining a reservoir 16 for retaining tattoo ink. The side wall of the container is preferably made of light transmissive plastic such that the color of the ink and the quantity of the ink in reservoir 16 can be readily observed.

Body 10 of container is also provided with a removable cover (not shown) to close the open mouth 18 ink reservoir 16 of the container when not in use. The cover may be a foil sheet, a screw cap or other suitable closure.

Container A includes means for engaging another container. The engaging means includes first and second sets of spaced interlocking members 20, 22 extending outwardly from the container in opposite directions. Each of the interlocking members 20, 22 has a particular size and shape, as can be observed from the drawings.

Figure 3:
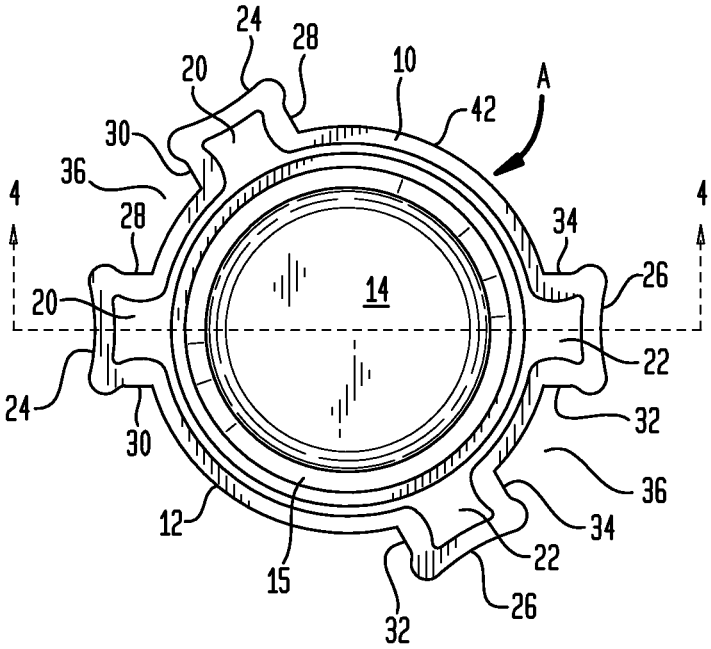
FIG. 3 is a bottom elevation view of the container.

As best seen in FIG. 3, which shows the bottom of the container, members 20, 22 are preferably hollow and each member has a generally rectangular shape defined by a linear or slightly arcuate outer wall 24, 26 and a pair of spaced, opposing side walls 28, 30 and 32, 34 respectively. Side walls are concave such that the shortest distance between each set of side walls is less than the length of the outer wall extending between those side walls. Members 20, 22 of each set define a space 36 therebetween of a size and shape necessary to firmly engage a member 20, 22 from another container to interlock the containers, as is illustrated in FIG. 5.

Figure 5:
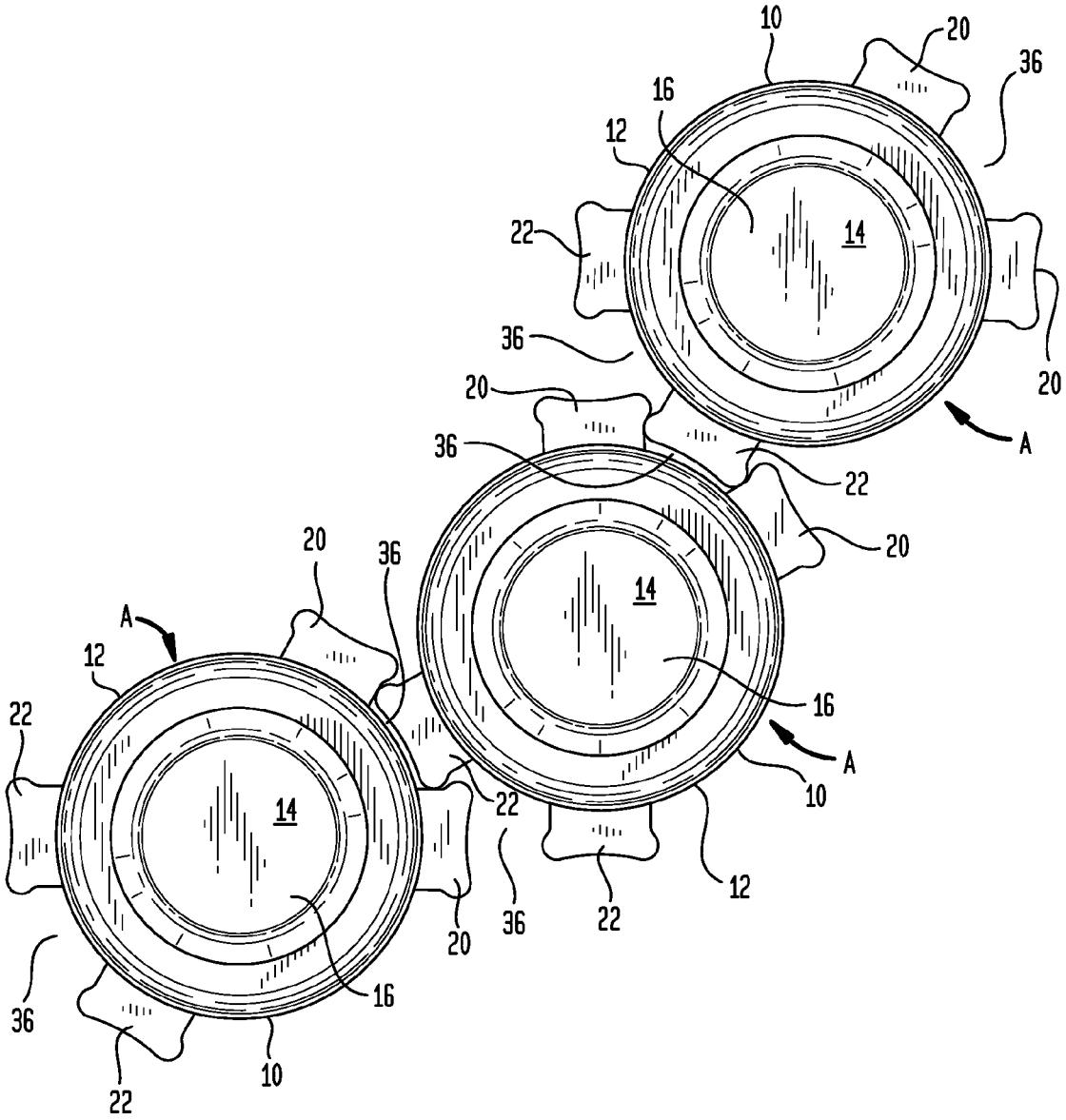
FIG. 5 is a top elevation view of an assembly of several interlocked containers arranged in one possible configuration.

It should be understood that FIG. 5 illustrates one example of an interlocking configuration of three containers. However, many different interlocking configurations are possible, depending upon the number of containers which are interlocked and the orientation of the container with respect to each other. Accordingly, the particular configuration depicted in FIG. 5 should not be considered as a limitation on the invention disclosed herein as it is provided for illustrative purposes only.

Figure 4:
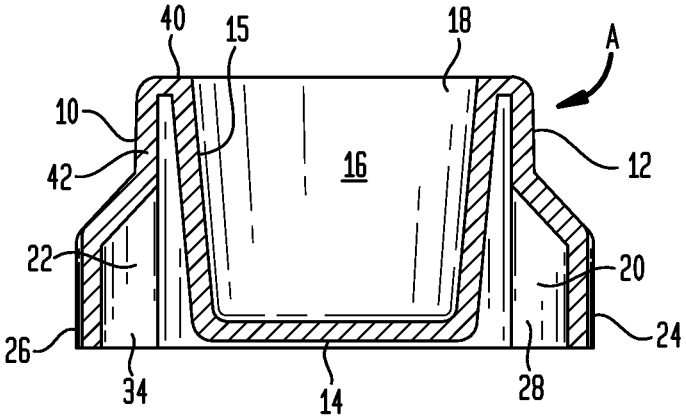
FIG. 4 is a cross-sectional view of the container taken along line 4-4 of FIG. 2.

As best seen from the cross-sectional view of FIG. 4, the reservoir 16 of container body 10 has an open mouth defined by a rim 40. The container is formed of an outer wall portion 42 which is substantially perpendicular to bottom 14 and which extends from rim 40 to the plane of bottom 14 of the container. Outer wall portion 42 surrounds an inner wall portion 15 which defines the inclined side surface of ink reservoir 16, but is spaced a short distance from inner wall portion 15. The interlocking members 20, 22 extend outwardly from the lower portion of the outer wall portion 42, providing additional stability to the container, and reducing the risk that the container will be accidentally tipped over.

It will now be appreciated that the containers of the present invention can be connected together by placing one of the interlocking members of one container into one of the spaces 36 of another container. This permits the tattoo artist to form an assembly connected containers arranged in many different configurations, including the configuration of FIG. 5. This permits the assembly of containers to be moved on the work surface as a unit, without the necessity of placing the containers on a tray. It also prevents any one of the connected containers from being accidentally tipped over.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims.

I claim:

1. First and second interlocking containers for tattoo ink, each of said containers comprising a generally circular body defining a reservoir for retaining ink, and means for engaging said other container, said engaging means comprising a pair of spaced, substantially radially extending interlocking members, wherein each of said interlocking members comprises substantially parallel side walls and an outer wall extending between said side walls, said side walls and said outer wall defining rounded corners which extend beyond said side walls in substantially opposite directions, and wherein the interlocking members of said pair are shaped and spaced apart to receive an interlocking member of substantially similar shape from said other container, wherein at least one of said interlocking members has an inclined top surface, and wherein said top surface of said interlocking member is downwardly and outwardly inclined from said exterior wall of said body.

2. The containers of claim 1 wherein said body of each of said containers has a bottom surface situated in a plane and wherein said engaging means of each of said containers extend into said plane.

3. An interlocking container for tattoo ink comprising a body having a substantially circular exterior wall and an interior wall, spaced from said exterior wall, said interior wall defining a reservoir for retaining ink, said container comprising a first interlocking member for engaging another container, said first interlocking member comprising first and second substantially parallel side walls extending from said exterior wall of said body and an outer wall extending between said side walls, said side walls and said outer wall defining rounded corners which extend beyond said side walls in substantially opposite directions, each of said corners and the adjacent side wall defining a recess, wherein said outer wall is slightly concave.

4. First and second interlocking containers for tattoo ink, each of said containers comprising a generally circular body defining a reservoir for retaining ink, and means for engaging said other container, said engaging means comprising a pair of spaced, substantially radial extending interlocking members, wherein each of said interlocking members comprises substantially parallel side walls and an outer wall extending between said side walls, said side walls and said outer wall defining rounded corners which extend beyond said side walls in substantially opposite directions, and wherein the interlocking members of said pair are shaped and spaced apart to receive an interlocking member of substantially similar shape from said other container, wherein each of said interlocking members has an inclined top surface, and wherein said top surface of said interlocking members is downwardly and outwardly inclined from said body.

5. An interlocking container for tattoo ink comprising a body having a substantially circular exterior wall and an interior wall, spaced from said exterior wall, said interior wall defining a reservoir for retaining ink, said container comprising a first interlocking member for engaging another container, said first interlocking member comprising first and second substantially parallel side walls extending from said exterior wall of said body and an outer wall extending between said side walls, said side walls and said outer wall defining rounded corners which extend beyond said side walls in substantially opposite directions, each of said corners and the adjacent side wall defining a recess, wherein said first interlocking member has an inclined top surface, and wherein said top surface of said first interlocking member is downwardly and outwardly inclined from said exterior wall of said body.

6. The container of claim 5 further comprising a second interlocking member spaced from said first interlocking member, said first and second interlocking members defining an opening therebetween adapted to receive an similarly shaped interlocking member from another container therebetween.

7. An interlocking container for tattoo ink comprising a body having a substantially circular exterior wall and an interior wall, spaced from said exterior wall, said interior wall defining a reservoir for retaining ink, said container comprising a first interlocking member for engaging another container, said first interlocking member comprising first and second substantially parallel side walls extending from said exterior wall of said body and an outer wall extending between said side walls, said side walls and said outer wall defining rounded corners which extend beyond said side walls in substantially opposite directions, each of said corners and the adjacent side wall defining a recess, wherein said interlocking member is hollow.

8. An interlocking container for tattoo ink comprising a body having a substantially circular exterior wall and an interior wall, spaced from said exterior wall, said interior wall defining a reservoir for retaining ink, said container comprising a first interlocking member for engaging another container, said first interlocking member comprising first and second substantially parallel side walls extending from said exterior wall of said body and an outer wall extending between said side walls, said side walls and said outer wall defining rounded corners which extending beyond said side walls in substantially opposite directions, each of said corners and the adjacent side wall defining a recess, wherein said interlocking member has an open bottom.

9. The container of claim 8 wherein said body has a substantially planar bottom surface and said first interlocking member has a bottom surface situated in the plane of said bottom surface of said body.

10. The container of claim 8 wherein said first interlocking member has an inclined top surface.

11. First and second interlocking containers for tattoo ink, each of said containers comprising a generally circular body defining a reservoir for retaining ink, and means for engaging said other container, said engaging means comprising a pair of spaced, substantially radially extending interlocking members, wherein each of said interlocking members comprises substantially parallel side walls and an outer wall extending between said side walls, said side walls and said outer wall defining rounded corners which extend beyond said side walls in substantially opposite directions, and wherein the interlocking members of said pair are shaped and spaced apart to receive an interlocking member of substantially similar shape from said other container, wherein at least one of said interlocking members is hollow.

12. The container of claim 11 wherein each of said interlocking members has an inclined top surface.

13. First and second interlocking containers for tattoo ink, each of said containers comprising a generally circular body defining a reservoir for retaining ink, and means for engaging said other container, said engaging means comprising a pair of spaced, substantially radially extending interlocking members, wherein each of said interlocking members comprises substantially parallel side walls and an outer wall extending between said side walls, said side walls and said outer wall defining rounded corners which extend beyond said side walls in substantially opposite directions, and wherein the interlocking members of said pair are shaped and spaced apart to receive an interlocking member of substantially similar shape from said other container, wherein at least one of said interlocking members has an open bottom.

14. The container of claim 13 wherein at least one of said interlocking members has an inclined top surface.

* * * * *